United States Patent [19]

Rowlett

[11] Patent Number: 4,632,647

[45] Date of Patent: Dec. 30, 1986

[54] SIDE ENTRY DOWN HOLE PUMP FOR OIL WELLS

[76] Inventor: Jack Rowlett, Rte. 2, Paola, Kans. 66071

[21] Appl. No.: 740,498

[22] Filed: Jun. 3, 1985

[51] Int. Cl.[4] ..... F04B 7/04; F04B 21/04; F16J 9/00

[52] U.S. Cl. ..... 417/498; 417/554; 417/490; 92/244

[58] Field of Search ..... 92/244; 417/490, 495, 417/498, 554, 553, 552

[56] References Cited

U.S. PATENT DOCUMENTS

| | | | |
|---|---|---|---|
| 209,258 | 10/1878 | Hawna | 92/244 |
| 1,041,375 | 10/1912 | Thompson | 417/490 |
| 1,178,217 | 4/1916 | Conrader | 92/244 |
| 1,703,423 | 2/1929 | Herman | 417/495 |
| 2,193,020 | 3/1940 | Collins | 417/495 |
| 2,583,111 | 1/1952 | Mardis | 417/554 |
| 2,627,233 | 3/1953 | McConnohie | 92/244 |
| 2,853,347 | 9/1958 | Cooper, Jr. | 92/244 |
| 3,578,886 | 5/1971 | Nino | 417/495 |
| 3,741,078 | 6/1973 | Johnson | 92/244 |
| 3,910,730 | 10/1975 | Gage | 417/554 |

*Primary Examiner*—Carlton R. Croyle
*Assistant Examiner*—Paul F. Neils
*Attorney, Agent, or Firm*—Kokjer, Kircher, Bradley, Wharton, Bowman & Johnson

[57] ABSTRACT

A side entry down-hole pump for oil wells which relies upon gravity rather than suction to receive incoming oil. A pump barrel is plugged at its bottom end and is anchored in the well. A pair of inlet slots in the side of the pump barrel admit oil to a pump chamber formed in the barrel between the inlet slots and the closed bottom end of the barrel. A pumping element is formed by a plunger assembly which includes a cup body carrying a pair of cup shaped seal rings. A pumping string reciprocates the pumping element up and down and provides a flow passage through which oil is pumped to the surface. During upstrokes, the seal rings move above the inlet slots so that oil flows by gravity through the slots and into the pump chamber. Downstrokes effect compression of oil in the pump chamber to pump it through the flow passage and through a check valve which prevents downflow of oil. A pair of discharge slots in the pump barrel relieve pressure created by oil trapped above the seal rings.

13 Claims, 6 Drawing Figures

SIDE ENTRY DOWN HOLE PUMP FOR OIL WELLS

BACKGROUND OF THE INVENTION

This invention relates in general to the pumping of fluids and deals more specifically with a down hole pump which has particular utility in pumping highly viscous oil and oil that is heavily gaseous.

Conventional down hole pumps used in oil wells operate by alternately creating suction and pressure in a pumping chamber that is submerged in the oil column in the well. Vacuum is created in the pumping chamber in order to draw in fluid when the pump is open, and the fluid is subjected to pressure in the pumping chamber when the pump is closed. The pressure causes the fluid to be pumped to the surface. Proper performance of this type of pump requires that the pumping chamber be sealed at all times, and this is not always possible, especially if the components of the pump have been subjected to extensive service. Any components of the pump that have been worn to the point of leaking cause the pump to malfunction.

Conventional pumps which rely upon suction are unable to effectively pump highly viscous oil. When viscous oil is to be pumped, the suction in the pump chamber is often insufficient to draw the oil into the pump. Due to the high viscosity of "heavy oil", it does not respond to vacuum in the same manner as lighter oil, and the vacuum is unable to draw the highly viscous oil into the loading chamber in sufficient quantity for the pump to operate effectively. As a consequence, pumps which operate on the basis of vacuum are unable to function at all or at best are only marginally effective in pumping highly viscous oil. Screw pumps must therefore be used to pump heavy oil, and they are less than satisfactory in a number of important respects.

Conventional pumps are also subject to "gas locking" which makes them ineffective in pumping gaseous oil. If gas laden oil is encountered, the gas is sucked into the pumping barrel along with the oil, thus inhibiting the pumping action. When a considerable volume of gas is present in the pumping chamber, the gas is compressed and expanded during pumping strokes and the pump energy is expended in gas compression rather than in pumping of liquid. Once a sufficient quantity of gas is present to create what is known as "gas locking" in the industry, the pump is unable to develop a vacuum in the loading chamber and additional fluid is not drawn into the pump. At this point, liquid is either not pumped at all or at best is pumped in only minimal quantities. The "gas locking" problem is particularly severe in stripper wells where enhanced recovery methods such as gas injection are often used, and much effort and financial resources have been devoted to its solution without significant success.

SUMMARY OF THE INVENTION

The present invention is directed to an improved down hole pump which is able to pump even highly viscous oil and which is not plagued by "gas locking" problems. In accordance with the invention, a pump barrel anchored in the well is closed at its bottom end and provided in its side with a pair of diametrically opposed slots which admit fluid to the pump barrel. A reciprocating plunger in the pump barrel carries cup shaped seal rings which seal against the pump barrel and move past the inlet slots as the plunger is reciprocated up and down by a pumping string. The plunger and pumping string cooperate to provide a flow passage which extends to the surface of the well from the pumping chamber located at the bottom end of the pump barrel below the inlet slots. A check valve formed by a ball and seat allows fluid to flow upwardly but not downwardly in the flow passage.

During each upstroke of the plunger, the seal rings are raised above the inlet slots, and oil from the well is then able to flow by gravity through the slots and into the pump chamber. The next downstroke carries the seal rings below the inlet slots and the plunger thereafter applies compressive force to the fluid in the pump chamber, causing the oil to flow upwardly through the flow passage and past the check valve. During the next upstroke, the check valve closes to prevent fluid in the flow passage from falling back down into the pump chamber. Above the inlet slots, a pair of discharge slots are formed in the side of the pump barrel so that oil trapped above the seal rings is forced out through the discharge slots to avoid the application of undue back pressure on the plunger during its upstrokes.

The use of gravitational forces rather than suction for loading of the pump chamber allows the pump of the present invention to handle viscous and gaseous oil without significant problems. Gravity causes the oil to flow into the pump chamber and, in contrast to suction pumps, the oil will respond to gravity even if it is highly viscous. Thus, even "heavy oil" will be loaded into the pump chamber of its own accord, and highly viscous oils can be pumped as well as less viscous oils. Because gravity is used for loading of the pump chamber, any gas which is present is displaced and forced out of the pump chamber by the incoming liquid oil. Consequently, gas is driven out of the pump chamber and "gas locking" is avoided to permit effective use of virtually all of the energy in the pumping of liquid oil to the surface of the well.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
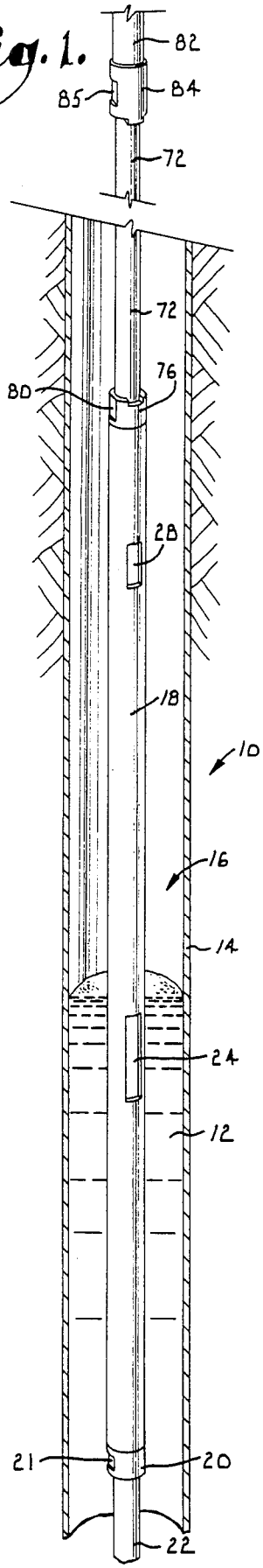
FIG. 1 is a fragmentary perspective view of an oil well equipped with a down hole pump constructed according to a preferred embodiment of the present invention, with the broken away portions indicating continuous length.

Referring now to the drawings in more detail and initially to FIG. 1, numeral 10 generally designates an oil well containing a column of oil 12 within steel casing 14. The well 10 is drilled and cased in a conventional manner.

Numeral 16 generally designates a down hole pump which is constructed in accordance with the present invention and which operates to pump the oil 12 to the surface of the well. The pump 16 includes a cylindrical pump barrel 18 which may be a brass pipe four feet long and having an outside diameter of 1.75 inches and an inside diameter of 1.5 inches. Preferably, the inside surface of the barrel 18 is polished to provide a mirro finish. An adapter plug 20 having wrench flats 21 is threaded into the bottom of the pump barrel 20 and serves to close the pump barrel at its bottom end. A hold down pipe 22 is threaded into the bottom of the adapter plug 20. The hold down pipe 22 is held down in the well 10 by means of a weighted anchor or a mechanical or cup type hold down arrangement (not shown).

Figure 6:
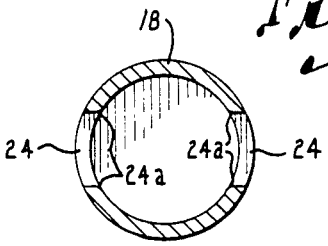
FIG. 6 is a fragmentary sectional view on an enlarged scale taken generally along line 6—6 of FIG. 2 in the direction of the arrows.

Inlet ports for admitting the oil 12 to the interior of the pump barrel 18 are formed by a pair of inlet slots 24 which are spaced above the closed bottom end of the pump barrel by approximately 17 inches in a preferred form of the invention. The slots 24 extend through the side of barrel 18. As best shown in FIG. 6, the slots 24 are diametrically opposed to one another and are beveled at 24*a* on their inside edges for a purpose that will be made clear. Each slot 24 is approximately 4 inches long and ¾ inch wide. A pump chamber 26 (see FIGS. 2–4) is formed in the lower portion of barrel 18 between the inlet slots 24 and the closed bottom end of the pump barrel. As shown in FIG. 1, the inlet slots 24 are located below the level of oil within the well casing 14 so that the oil can naturally flow by gravity into the slots.

Oil discharge ports are formed by a pair of diametrically opposed discharge slots 28 which are formed in the side of the pump barrel 18 at a location well above the inlet slots 24. The discharge slots 28 are located about 6 inches from the top end of barrel 18, and each slot may be two inches long and ¾ inches wide.

Figure 4:
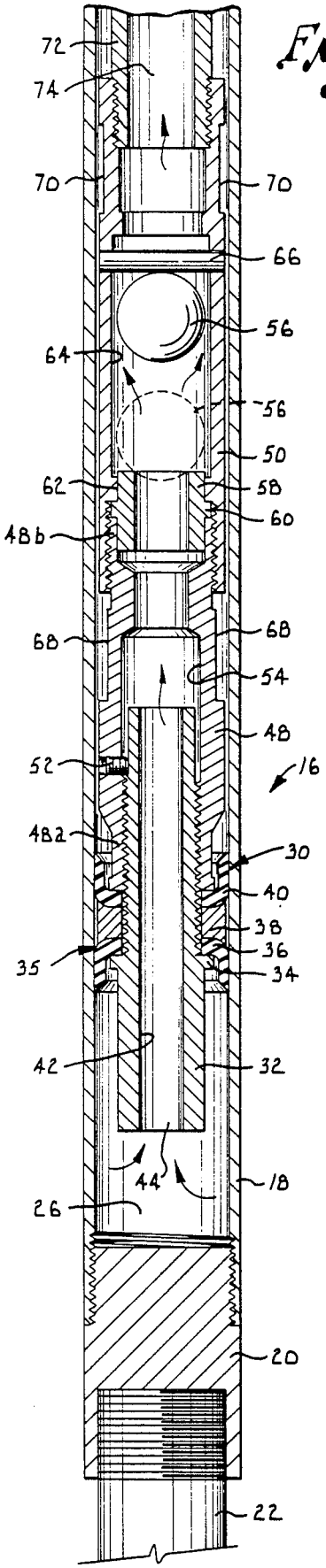
FIG. 4 is a fragmentary sectional view on an enlarged scale taken generally along line 4—4 of FIG. 3 in the direction of the arrows, with the broken lines showing the check ball in its seated or closed position.

Pumping action is provided by a reciprocating plunger assembly which is generally designated by numeral 30 and best shown in FIG. 4. A cylindrical cup body 32 at the bottom of the plunger assembly has a projecting collar 34 which provides an upwardly facing shoulder for properly positioning a seal assembly 35. The seal assembly includes a lower cup shaped seal ring 36 engaged against collar 34. A rigid spacer 38 is sandwiched between the lower seal ring 36 and an identical upper seal ring 40. The lower seal ring 36 faces downwardly, while the upper seal ring 40 faces upwardly in a back to back arrangement with the lower ring. The spacer 38 is provided with curved recesses in its opposite faces to accommodate the seal rings 36 and 40. The seal rings and spacer encircle and are carried on the cup body 32. The seal rings provide a seal between the cup body 32 and the inside surface of the pump barrel 18. The seal rings may be formed from neoprene or another suitable material.

Figure 2:
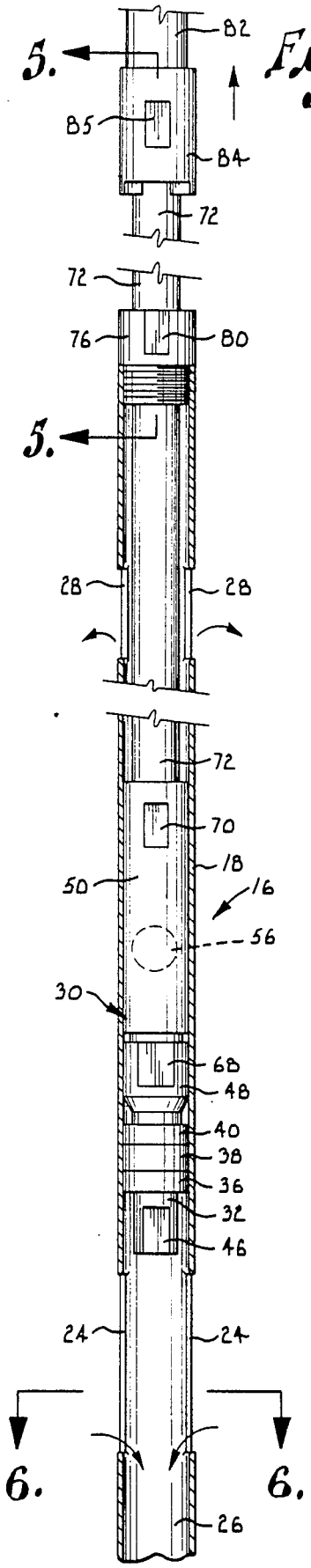
FIG. 2 is a fragmentary sectional view of the upper portion of the pump on an enlarged scale, with the broken away portions indicating continuous length and the pump shown in the open position during an upstroke.
Figure 3:
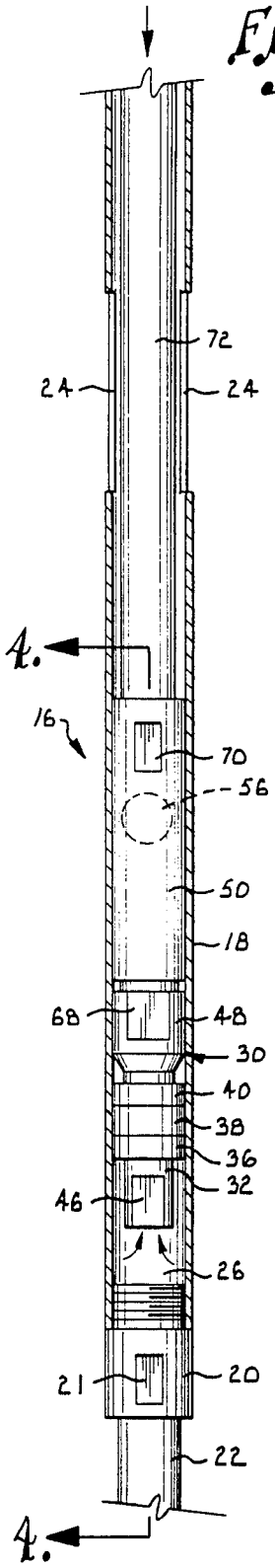
FIG. 3 is a fragmentary sectional view of the lower portion of the pump, with the pump shown in its closed position during a downstroke.

Extending through the cup body 32 is a central passage 42 having an inlet 44 at its open bottom end. The inlet 44 receives oil from the pump chamber 26 during operation of the pump, as will be described more fully. A pair of wrench flats 46 are formed on the lower end of the cup body 32, as best shown in FIGS. 2 and 3.

An adapter pipe 48 connects the cup body 32 with a cage structure forming a valve body 50 for a check valve. The adapter pipe 48 is internally threaded on its lower end in order to mate with external threads formed on cup body 32 above the collar 34. The adapter 48 is tightened on the cup body 32 until the lower end 48*a* of the adapter acts against the upper seal ring 40 in order to compress the two seal rings and spacer 36 between the collar 34 and the lower end 48*a* of the adapter. Compression of the seal rings causes them to form an effective seal between the plunger assembly 30 and the pump barrel 18. A set screw 52 is threaded through the adapter 48 and tightened against the cup body 32. A central passage 54 is formed through the adapter 18 to receive oil from the passage 42 of cup body 32.

The upper end portion of adapter 48 is externally threaded to mate with the internally threaded lower end of the valve body 50. A ball 56 in valve body 50 cooperates with a seat 58 to form a check valve which permits fluid to flow upwardly but not downwardly through the seat 58. A collar 60 projects outwardly from seat 58 and rests on the top end 48*b* of adapter 48. When the valve body 50 is threaded onto adapter 48, an internal flange 62 projecting from the inside surface of the valve body is tightened on collar 60 in order to rigidly hold the valve seat 58 in place.

A valve chamber 64 formed in the valve body 50 is slightly larger in diameter than the ball 56. Consequently, when the ball is displaced from the valve seat 58 as shown in solid lines in FIG. 4, fluid is able to flow upwardly through the seat 58 and valve chamber 64 past the ball. However, when ball 56 is seated against the seat 58, as shown in broken lines in FIG. 4, the flow passage is closed and fluid is unable to flow downwardly past the ball and through the valve seat. A pin 66 extends diametrically across the valve body 50 at a location well above seat 58 in order to prevent the ball 56 from moving upwardly beyond the position shown in solid lines in FIG. 4.

As best shown in FIGS. 2 and 3, the exterior surface of the adapter 48 may be provided with wrench flats 68. Similar wrench flats 70 may be provided on the valve body 50 in order to facilitate threading and unthreading of the parts.

Figure 5:
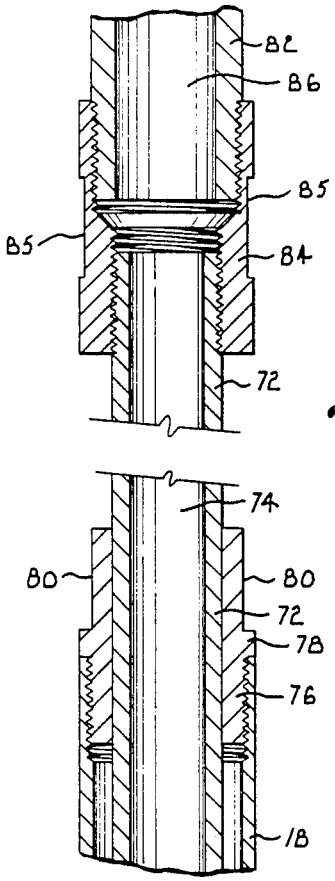
FIG. 5 is a fragmentary sectional view on an enlarged scale taken generally along line 5—5 of FIG. 2 in the direction of the arrows, with the broken away portion indicating continuous length.

A pull tube 72 is threaded into the upper end of the valve body 50. The pull tube 72 may be a ¾ inch outside diameter tube having a passage 74 extending through it and communicating at its lower end with the valve chamber 64. The pull tube 72 extends slidably through a guide 76 which is threaded into the top end of the pump barrel 18. As best shown in FIG. 5, the guide 76 has a collar 78 which is tightened against the top end of barrel 18 when the guide is fully threaded into the barrel. Wrench flats 18 may be provided on the outside surface of the guide 76.

The pull tube 72 forms part of a pumping string which is used to reciprocate the plunger assembly 30. Also forming part of the pumping string is another tube 82 which is connected at its lower end with the upper end of tube 72. A coupling 84 having wrench flats 85 connects tubes 72 and 82 end to end. A passage 86 in the upper tube 82 forms an extension of passage 74. The pumping string may include additional tubes connected end to end and eventually reaching the surface of the well. Suitable machinery is used to raise and lower the pumping string in order to effect upstrokes and downstrokes of the plunger assembly 30. The passages formed through the parts of the plunger assembly and pumping string cooperate to form a fluid flow passage with extends from the pump chamber 26 to the surface of the well in order to deliver the pumped oil to the surface.

In operation of the pump, the pumping string is driven up and down by conventional machinery (not shown) to effect alternating upstrokes and downstrokes of the plunger assembly 30. During each upstroke, the seal rings 36 and 40 are raised above the inlet slots 24. The pump is then in the open position and the oil 12 is able to freely flow through the inlet slots 24 and into the pump chamber 26 under the influence of gravity. When the plunger has reached the top of its stroke, the seal rings are located between the inlet slots 24 and the discharge slots 28.

The plunger assembly is then driven in a downstroke which carries the seal rings 36 and 40 downwardly past the inlet slots 24. Once the seal rings have moved below the inlet slots, they are sealed from the pump chamber 26 and the pump is closed. Continued downward movement of the plunger results in the application of compressive force to the oil contained in the pump chamber 26. The compressive force causes the oil to flow upwardly from the pump chamber 26 into the inlet 44 of passage 42. The oil is pumped upwardly through the flow passage and past the ball 56 which is unseated by the pressure. The oil flow past ball 56 and upwardly to the surface through the flow channel provided within the pumping string.

At the end of the downstroke, the plunger assembly is located at the bottom of the pump barrel and then begins to move upwardly during the next upstroke. At the upstroke begins, pressure is removed from below the ball 56, and the ball returns to its seated position against the valve seat 58. The oil which is trapped in the flow passage above the ball 56 is prevented by the check valve from flowing downwardly back into the pump barrel. The check valve remains closed throughout the upstroke of the plunger.

As the seal rings 36 and 40 move upwardly past the inlet slots 24, oil again is able to flow naturally by gravity through the inlet openings and into the pump chamber 26. Any oil that is trapped in the pump barrel above the upper seal ring 40 is discharged from the pump barrel through the discharge slots 28 as the plunger moves upwardly above the inlet slots 24. In this manner, the discharge slots 28 relieve the pressure above the seal assembly and prevent undue back pressure from being applied to the plunger. In the absence of discharge slots, highly viscous oil can create a fluid restriction above the seal rings which can raise the pump barrel and hold down arrangement from their proper positions in the well.

The plunger assembly 30 is reciprocated in this manner through successive cycles to pump the oil from the well to the surface. Because gravity rather than suction is relied upon to fill the pump chamber 26, even highly viscous "heavy oil" can be pumped to the surface without undue difficulty. At the same time, the gravity flow system allows oil to enter and fill the pump chamber 26 and to displace any gas that may be present in the pump chamber. Consequently, significant amounts of gas are not present in the pump chamber during the pumping strokes, and the problem of "gas locking" is eliminated. Because the pumping energy is not expanded in compressing gas, the energy is used in an efficient manner in the pumping of liquid oil to the surface.

If desired, additional cup shaped seal rings can be installed to back up the lower seal ring 36 which is used in the application of compressive forces to the oil in the pump chamber 26. The upper seal ring 40 is used primarily in raising oil that is trapped in the pump barrel above the inlet openings 24 to assure that the trapped oil is discharged through the discharge openings 28 in order to avoid undue back pressure on the plunger assembly. The beveled inside edges **24*a* of the inlet slots 24 reduce wear on the seal rings as they move back and forth past the inlet slots during upstrokes and downstrokes of the plunger. The cup shaped configuration of each seal ring 36 and 40 and their back to back arrangement allows the seal rings to perform their intended functions while maintaining effective seals against the inside surface of the pump barrel 18. If necessary, the pump chamber can be vented on the upstroke of the pump by a suitable venting arrangement such as a check valve similar to the ball 56 and seat 58** interposed between the pump barrel and hold down pipe.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A submersible pump for pumping fluid from an oil well, said pump comprising:

a pump barrel in the well having a closed bottom end and a side surface provided with a fluid inlet port spaced above said bottom end but located below the level of the fluid in the well, said pump barrel defining a pump chamber therein between said bottom end and said inlet port;

a pump element received in said barrel for reciprocating movement carrying the pump element past said inlet port during upstrokes and downstrokes of the pumping element, said pump element presenting a flow passage having an inlet for receiving fluid from said pump chamber;

seal means on said pump element for sealing same to said pump barrel, said seal means being located above said inlet port in an open position of the pump to admit fluid through said port and into said pump chamber under the influence of gravity and said seal means being located below said inlet port in a closed position of the pump to seal the pump chamber from said port and apply pressure to the fluid in said chamber during downstrokes of said pump element therein;

a pumping string connected to said pump element for effecting reciprocation of same in said barrel, said pumping string presenting a flow channel communicating with said flow passage to deliver fluid to the surface of the well during downstrokes of the pump element in the flow chamber;

a check valve between said flow passage and flow channel permitting fluid flow upwardly therebetween but preventing fluid flow downwardly therebetween; and a fluid discharge port in the side of said pump barrel at a location above said inlet port and above said seal means in all positions thereof for discharging from the pump barrel fluid trapped above said seal means.

2. The invention of claim 1, wherein said seal means comprises a pair of cup shaped seal elements carried on said pump element and arranged generally back to back thereon with a rigid spacer sandwiched between said seal elements.

3. The invention of claim 1, wherein said inlet port comprises a pair of slots at substantially diametrically opposed locations on the pump barrel.

4. The invention of claim 1, wherein said pump element comprises:

a cup body presenting said inlet and carrying said seal means thereon; and a valve body containing said check valve, said valve body being connected with said cup body and cooperating therewith to provide said flow passage.

5. The invention of claim 4, wherein said check valve comprises:

a ball member in said valve body; and a valve seat in said valve body for the ball member, said ball member closing the valve body when seated on the seat and opening the valve body to flow when unseated.

6. The invention of claim 5, including a pin in said valve body for limiting movement of said ball member away from said seat.

7. The invention of claim 4, including an adapter between said cup body and said valve body and cooperating therewith to provide said flow passage.

8. The invention of claim 7, wherein said seal means includes a seal element carried on said cup body, said seal element being compressed between a shoulder on said cup body and an end of said adapter.

9. The invention to claim 7, wherein:

said seal means includes a pair of cup shaped seal elements arranged back to back on said cup body with a spacer between them;

said cup body has an annular projecting shoulder; and said adapter has an end, said seal elements being compressed against said spacer between said shoulder and said end of the adapter.

10. A submersible pump for pumping fluid from an oil well, said pump comprising:

a pump barrel in the well having a closed bottom end;

an inlet port in the side of said pump barrel at a location above said bottom end for admitting fluid to a pump chamber defined in said pump barrel between the bottom end thereof and said inlet port;

a plunger received in said barrel for reciprocating movement carrying the plunger past said inlet port during upstrokes and downstrokes of the plunger, said plunger including a cup body carrying a plurality of seal rings for sealing the plunger to the pump barrel and said plunger presenting a flow passage having an inlet for receiving fluid from the pump chamber;

an adaptor pipe having a threaded connection with said cup body and having a hollow interior aligned with the flow passage of said plunger to receive fluid pumped therethrough, said adaptor pipe acting against said seal rings in a manner to effect compression of the rings to enhance the seal between the plunger and the pump barrel when said threaded connection is tightened;

a valve body on said adaptor pipe forming a closed cage structure having a valve chamber aligned with said hollow interior of the adaptor pipe and closed off from the well, said valve body carrying in said valve chamber a valve seat and a ball member cooperating with said seat to provide a check valve which closes the valve member to downward flow and opens the valve chamber to upward flow; and a pumping string connected with said valve body and operable to alternately effect upstrokes and downstrokes of said plunger carrying said seal rings above said inlet port to admit fluid from the well through the inlet port and into the pump chamber under the influence of gravity and then carrying said seal rings below the inlet port to apply pressure to the fluid in the pump chamber, said pumping string having a flow channel communicating with said valve chamber and extending to the surface of the well to deliver fluid to the surface during downstrokes of the plunger in said pump chamber.

11. A submersible pump for pumping fluid from an oil well, said pump comprising:

a pump barrel in the well having a closed bottom end;

a pair of inlet slots in the side of said pump barrel at a location above said bottom end for admitting fluid to a pump chamber defined in said pump barrel between the bottom end thereof and said slots, said slots being diametrically opposed to one another on said pump barrel end each slot having a length to width ratio greater than 4 to 1;

a pump element received in said barrel for reciprocating movement carrying the pump element past said inlet slots during upstrokes and downstrokes of the pump element, said pump element carrying seal means for sealing the pump element to the pump barrel and said pump element presenting a flow passage having an inlet for receiving fluid from the pump chamber and a check valve which closes the flow passage to downwardly flow and opens the passage to upward flow, said seal means including a pair of cup shaped seal elements arranged back to back on said pump element with a rigid spacer sandwiched between said seal elements;

a pumping string connected with said pump element and operable to alternatively effect upstrokes and downstrokes of same carrying said seal means above said inlet slots to admit fluid from the well through the inlet slots and into the pump chamber under the influence of gravity and then carrying said seal means below the inlet slots to apply pressure to the fluid in the pump chamber, said pumping string having a flow channel communicating with said flow passage and extending to the surface of the well to deliver fluid thereto during downstrokes of the pump element in said pump chamber; and said pump element comprising a cup body on which said seal elements are carried, said cup body providing said inlet to the flow passage and having a projecting shoulder engaging one of said seal elements, a valve body to which said pumping string is connected, said valve body containing said check valve, and an adapter connecting said cup body with said valve body and cooperating therewith to provide said flow passage, said adapter having an end engaging the other seal element to compress the seal elements between said shoulder and said end of the adapter.

12. The invention of claim 11, wherein said check valve comprises:

a valve seat in the flow passage; and a ball received in said flow passage above said valve seat for movement toward and away from said seat, said ball closing the flow passage when seated on said seat and opening said passage when unseated from the seat by fluid pressure from the pump chamber.

13. The invention of claim 11, including a discharge port in the side of said pump barrel at a location above said inlet slots and above said seal means in all positions thereof to discharge fluid trapped in the pump barrel above said seal means.

* * * * *